US009651343B2

(12) United States Patent
Miller

(10) Patent No.: US 9,651,343 B2
(45) Date of Patent: May 16, 2017

(54) METHODS AND APPARATUS FOR SMALL ARMS TRAINING

(71) Applicant: Raytheon Company, Waltham, MA (US)

(72) Inventor: Kenneth V. Miller, Rancho Cucamonga, CA (US)

(73) Assignee: Raytheon Company, Waltham, MA (US)

( * ) Notice: Subject to any disclaimer, the term of this patent is extended or adjusted under 35 U.S.C. 154(b) by 492 days.

(21) Appl. No.: 14/032,243

(22) Filed: Sep. 20, 2013

(65) Prior Publication Data

US 2015/0084281 A1 Mar. 26, 2015

(51) Int. Cl.

| | |
|---|---|
| ***F41J 5/00*** | (2006.01) |
| ***F41J 5/06*** | (2006.01) |
| ***F41J 5/14*** | (2006.01) |
| ***F41J 11/00*** | (2009.01) |

(52) U.S. Cl.

CPC . *F41J 5/06* (2013.01); *F41J 5/14* (2013.01); *F41J 11/00* (2013.01)

(58) Field of Classification Search

CPC ..... F41J 5/06; F41J 33/00
USPC ..... 434/16; 273/371; 235/400
See application file for complete search history.

(56) References Cited

U.S. PATENT DOCUMENTS

| | | | | |
|---|---|---|---|---|
| 5,944,317 | A * | 8/1999 | Rohrbaugh | F41J 5/06 235/400 |
| 6,109,614 | A | 8/2000 | Ciarcia | |
| 7,329,127 | B2 | 2/2008 | Kendir et al. | |
| 8,360,776 | B2 * | 1/2013 | Manard | F41A 33/00 434/16 |
| 2002/0197584 | A1 * | 12/2002 | Kendir | F41G 3/2655 434/21 |
| 2010/0320691 | A1 * | 12/2010 | McNelis | F41J 5/06 273/371 |
| 2011/0311949 | A1 * | 12/2011 | Preston | F41G 3/26 434/16 |

* cited by examiner

*Primary Examiner* — David L Lewis
*Assistant Examiner* — Ross Williams
(74) *Attorney, Agent, or Firm* — Daly, Crowley, Mofford & Durkee, LLP

(57) ABSTRACT

Method and apparatus for a small arms training system. In exemplary embodiments, a training system includes a control system, shooter systems that can include a user interface, and a target system that collects projectile position information in relation to a target. In one embodiment, the systems are linked via a mesh radio network and are configured to process GPS information for rapid and accurate positioning of the shooter in relation to the target.

20 Claims, 9 Drawing Sheets

METHODS AND APPARATUS FOR SMALL ARMS TRAINING

BACKGROUND

As is known in the art, public safety and military personnel must train diligently to maintain the ability to shoot safely and accurately. Conventional firearm training systems are often antiquated and limited in the amount and type of feedback provided to the shooter. While electronic training systems exist, they are prohibitively expensive. In addition, such systems require significant set up time and maintenance.

SUMMARY

The present invention provides method and apparatus for a small arms training system that is relatively low cost, flexible, deployable, and configurable for small arms qualification and battle zero (BZO) maintenance in ad-hoc field sites, stationary training venues, etc. In exemplary embodiments of the invention, a training system includes a control system, at least one shooter system with a user interface, and a target system that collects projectile location information in relation to a target. In one embodiment, the systems are linked via a mesh radio network and are configured to receive GPS information for accurate positioning. The targets can include a target frame and display and acoustic sensors to collect information to determine the accuracy of a round through the target. A score for the shot can be computed based on dynamic scoring including distance of the shooter, caliber, firearm type, conditions, etc.

In one aspect of the invention, a system, comprises: a target system including: a target area having a target, a GPS module to determine a location of the target, sensors to detect a projectile passing through the target area, and a module to determine a location of the projectile in relation to the target from information collected by the sensors, and a shooter system including: a wireless communication module to communicate with the target system, a user interface to provide information to a shooter.

The system can further include one or more of the following features: the sensors comprise acoustic sensors, a controller system to control the target system and the shooter system via wireless communication, the sensor comprises a first array of sensors arranged vertically along a first side of the target and a second array of sensors arranged horizontally along a second side of the target, a training module to provide shooter instruction to the shooter system in accordance with a selected training scenario, shooter database to store performance information for shooters from the target system, scoring module to score information from the sensors, the sensors are selected from the group consisting of acoustic sensors, video sensors, laser sensors, electro-optical sensors and temperature sensors, and/or the target system computes the projectile location from a time difference of arrival of sound waves at the sensors.

In another aspect of the invention, a method comprises: employing a target system including: a target area having a target, a GPS module to determine a location of the target, sensors to detect a projectile passing through the target area, and a module to determine a location of the projectile in relation to the target from information collected by the sensors, and employing a shooter system including: a wireless communication module to communicate with the target system, and a user interface to provide information to a shooter.

The method can further include one or more of the following features: the sensors comprise acoustic sensors, employing a controller system to control the target system and the shooter system via wireless communication, employing a training module to provide shooter instruction to the shooter system in accordance with a selected training scenario, employing a shooter database to store performance information for shooters from the target system, employing a scoring module to score information from the sensors, and/or the target system computes the projectile location from a time difference of arrival of sound waves at the sensors.

In a further aspect of the invention, a system, comprises: a target system means for determining a location of a projectile in relation to a target from information collected by sensors proximate a target area, a shooter system means for communicating distance information with the target system, and a user interface means for providing information to a shooter.

In a further aspect of the invention, an article comprises: at least one non-transitory computer readable medium having stored instructions that enable a machine to perform: receiving information from sensors configured to detect a projectile passing through the target area in a target system, which comprises: a target area having a target, and a GPS module to determine a location of the target, determining a location of the projectile in relation to the target from the information collected by the sensors, and communicating with a shooter system, which includes: a wireless communication module to communicate with the target system, and a user interface to provide information to a shooter. The article can further include instructions for scoring the projectile location including using position information of the shooter system in relation to the target system.

BRIEF DESCRIPTION OF THE DRAWINGS

The foregoing features of this invention, as well as the invention itself, may be more fully understood from the following description of the drawings in which.

DETAILED DESCRIPTION

Figure 1:
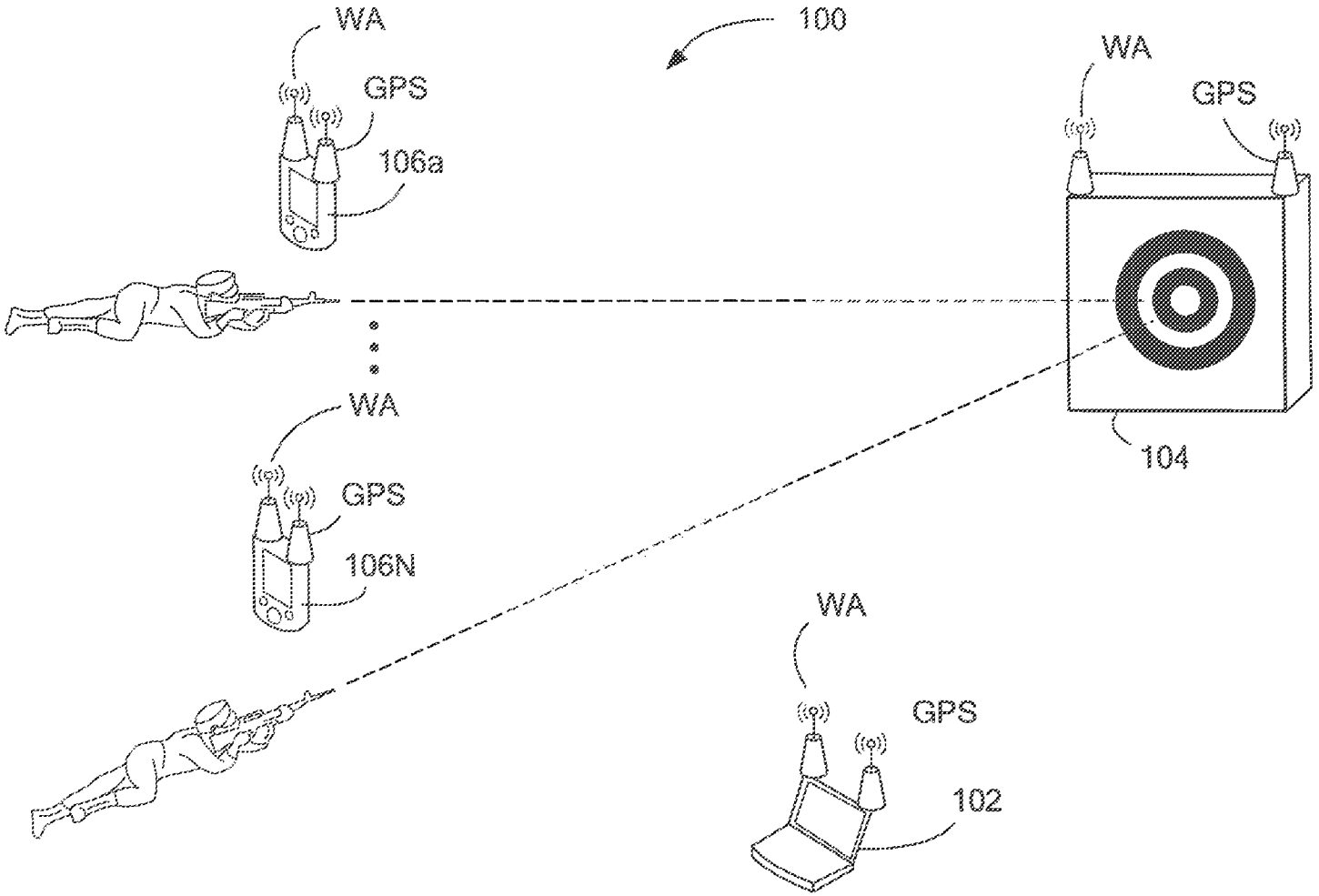
FIG. 1 is a schematic representation of a small arms training system in accordance with exemplary embodiments of the invention.

FIG. 1 shows an exemplary small arms training system 100 in accordance with exemplary embodiments of the invention. A control system 102 controls overall operation of the system 100 under the control of a user via a user interface, for example. A target system 104 is positioned at a desired location that is suitable for training. A series of shooter systems 106*a*-N can be positioned in relation to the target system 104 as desired to effect a given training scenario. The shooter system 106 gives instructions and feedback to the shooter, such as with a display and audio components. In an exemplary scenario, multiple shooters direct fire at a common target system 104. However, any practical number of target and shooter systems can be used.

In an exemplary embodiment, each of the control system 102, target system 104, and shooter systems 106 include a GPS antenna GPS and a wireless antenna WA. It is understood that the target, shooter and controller system can collect and communicate to determine accurate position information in relation to each other. With this arrangement, a user can readily instruct a shooter to a desired position and distance from the target via the controller and shooter systems 102, 106.

Once the target system 104 and the shooter systems 106 report their positions and communicate a 'ready' status, the controller system 102 computes the distances from each shooter system 106 to the target system 104. The controller system 102 can send the target system 104 an appropriate scaling factor for use in scoring the shots. In one embodiment, the scaling factor is determined by the distances between the shooters and the target and the course of fire to be scored. Since GPS information is collected and shared, shooter/target distances do not need to be determined manually. In addition, shooters can rapidly move to different distances for various training scenarios.

Figure 2:
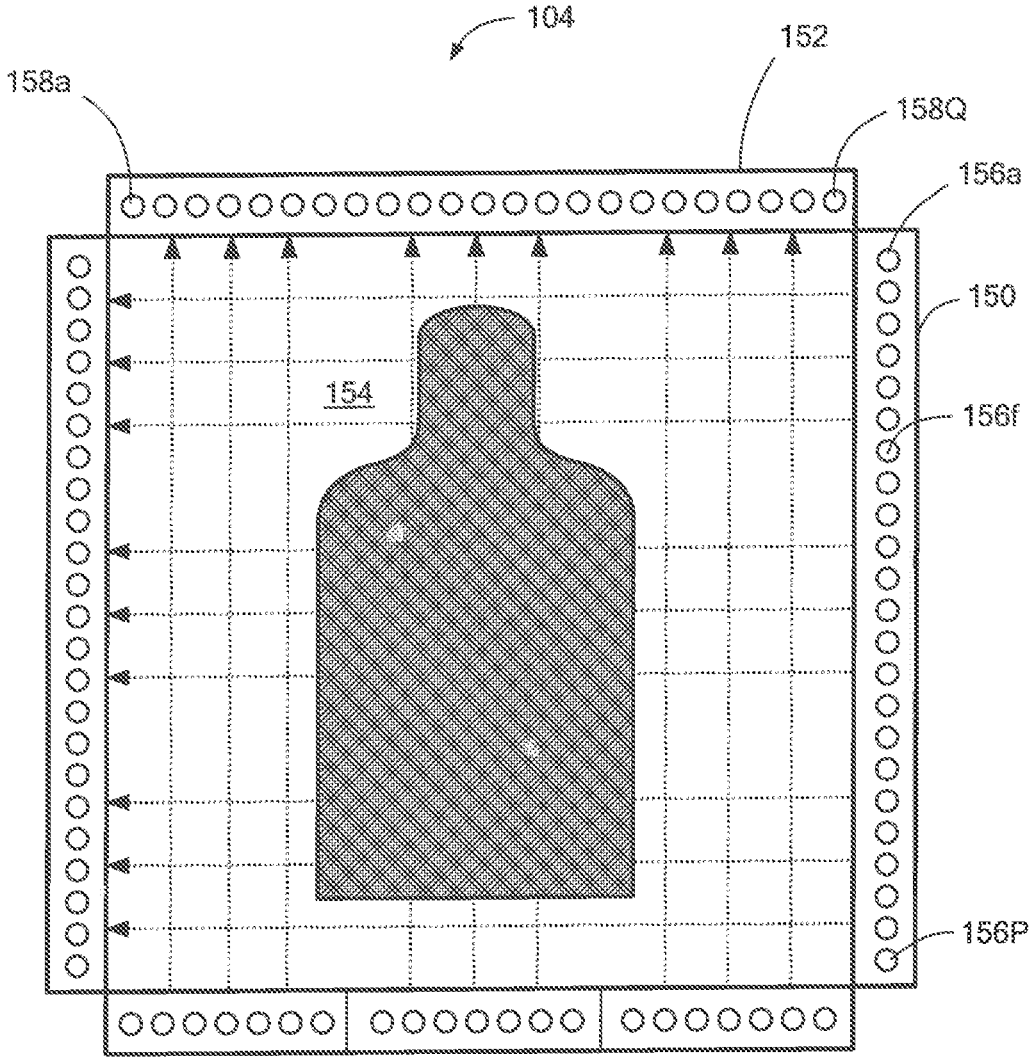
FIG. 2 is a schematic representation of an exemplary target system in accordance with exemplary embodiments of the invention.

FIG. 2 shows an exemplary target system 104 having first and second acoustic sensor blocks 150, 152 to detect sound generated by a projectile penetrating the target area 154. In an exemplary embodiment, the first acoustic sensor block 150 includes a series of spaced acoustic sensors 156*a*-P arranged vertically along a side of the target area 154 and the second acoustic block 152 includes a series of spaced acoustic sensors 158*a*-Q arranged horizontally along another side of the target area. In one particular embodiment, acoustic sensors 156, 158 are spaced at two inches on center and the target is six feet by six feet.

It is understood that the number and location of acoustic sensors can be selected to meet the needs of a particular application. In other embodiments, acoustic sensors can be located on additional sides of the target area and/or within the target area. Such sensors can be protected from incoming rounds. The location and number of sensors, along with sensor accuracy, determine the accuracy with which the impact point on the target can be located. It is understood that the size of the target can be of any practical size where the target size impacts the number of sensors.

Figure 3:
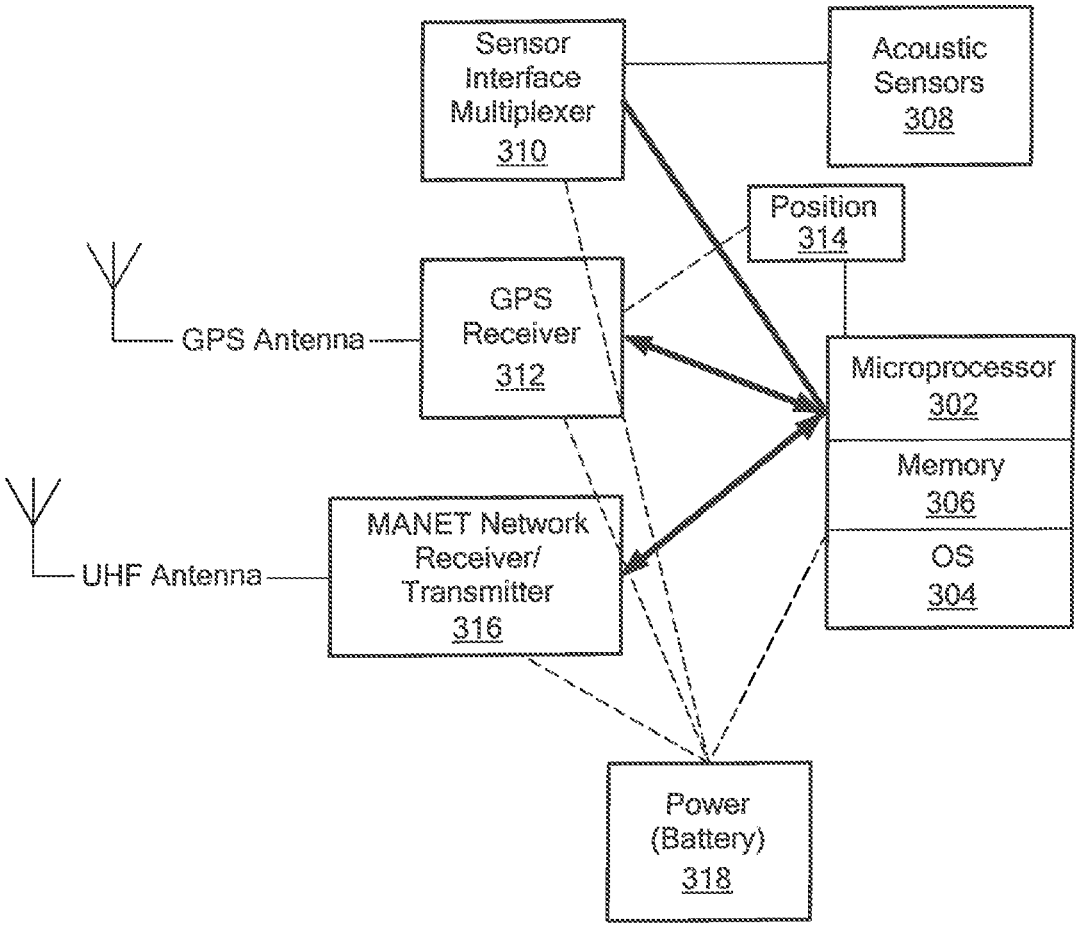
FIG. 3 is a schematic representation of an exemplary implementation of a target system.

FIG. 3 shows an exemplary target system 300 implementation including a processor 302, operating system 304, and memory 306 that enable the target system to provide user training and obtain user accuracy information. Acoustic sensor module 308 includes a number of acoustic sensors coupled to a sensor interface module 310 that can multiplex information to the processor module 302. A GPS receiver 312 is coupled to a position module 314 that can provide position information to the processor for transmission to the controller 102 (FIG. 1) and shooter system 106. A network module 316 provides wireless communication in a conventional manner. In one embodiment, a MANET (mobile ad hoc network) is used. A power module 318 can include a battery to provide power to the system.

While exemplary embodiments are shown having acoustic sensors, in other embodiments other types of sensor are used. In general, any suitable sensor can be used that can acquire a location of a round passing through the target area. Exemplary sensors include optical, electro/optical sensors, magnetic field sensors, video/camera sensors, air pressure sensors, laser sensors, and the like. In addition, multiple sensor types can be used to enhance the ability of the system to determine an accurate position of the round in relation to the target.

Figure 4:
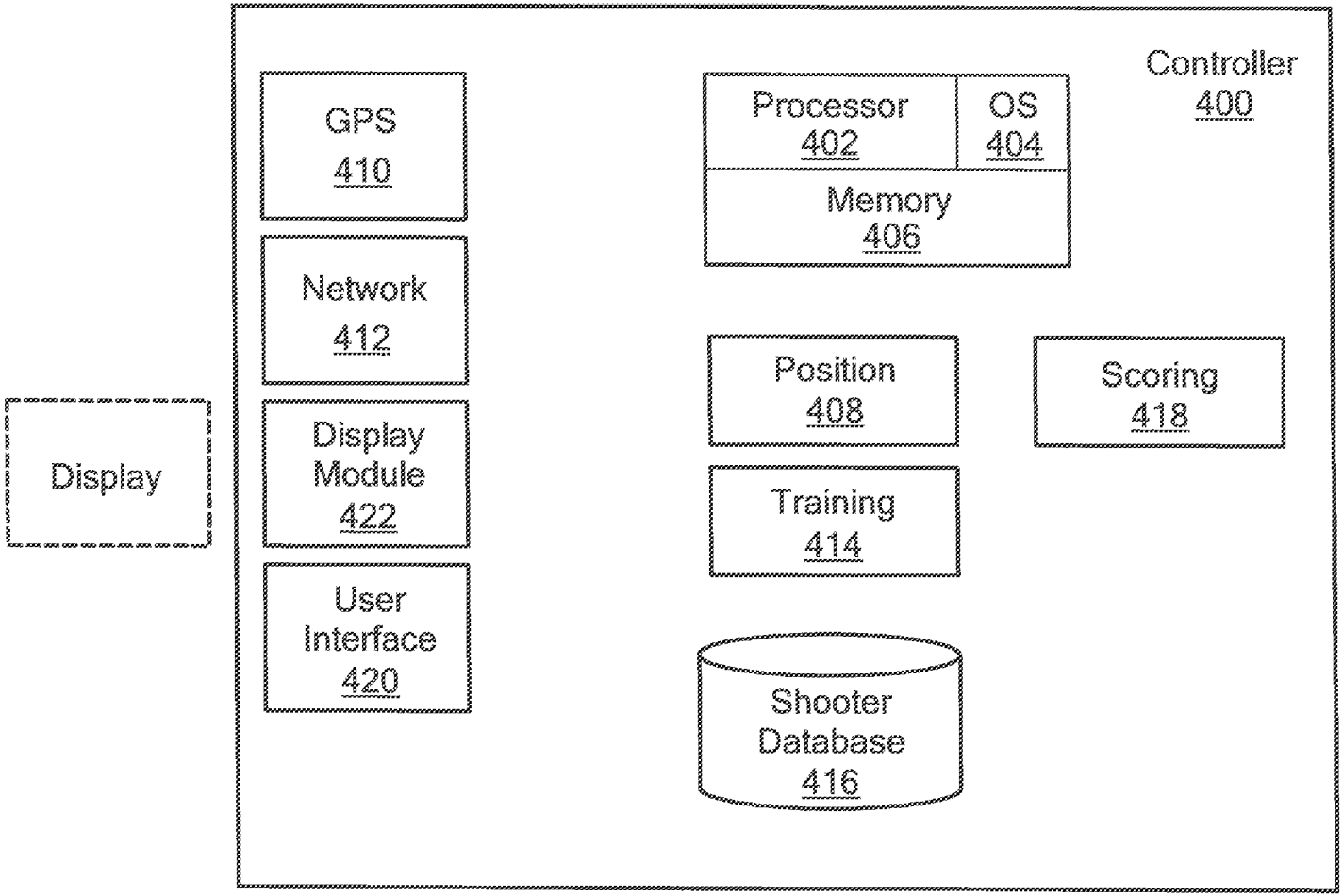
FIG. 4 is a schematic representation of an exemplary implementation of a controller system.

FIG. 4 shows an exemplary implementation of a controller system 400 including a processor 402, operating system 404, and memory 406 that enable the controller system to control overall operation and interface with a user to implement training and scoring. A position module 408 determines the position of the controller system from a GPS module 410 and obtains position information from the shooter and controller system via a wireless network module 412. The controller system 400 can instruct a shooter to move the shooter module to a given distance based upon a training regimen contained in a training module 414. A shooter database 416 can contain performance information for a given number of shooters. A scoring module 418 can computer shooter scoring information based upon the shooter distance, conditions, caliber, speed, etc., that can be stored in the database 416. The controller system 400 includes a user interface 420 and display module 422 to enable a user to interact with the system and implement desired training regimens. The display module 422 can format information for display on a display monitor, for example.

Figure 5:
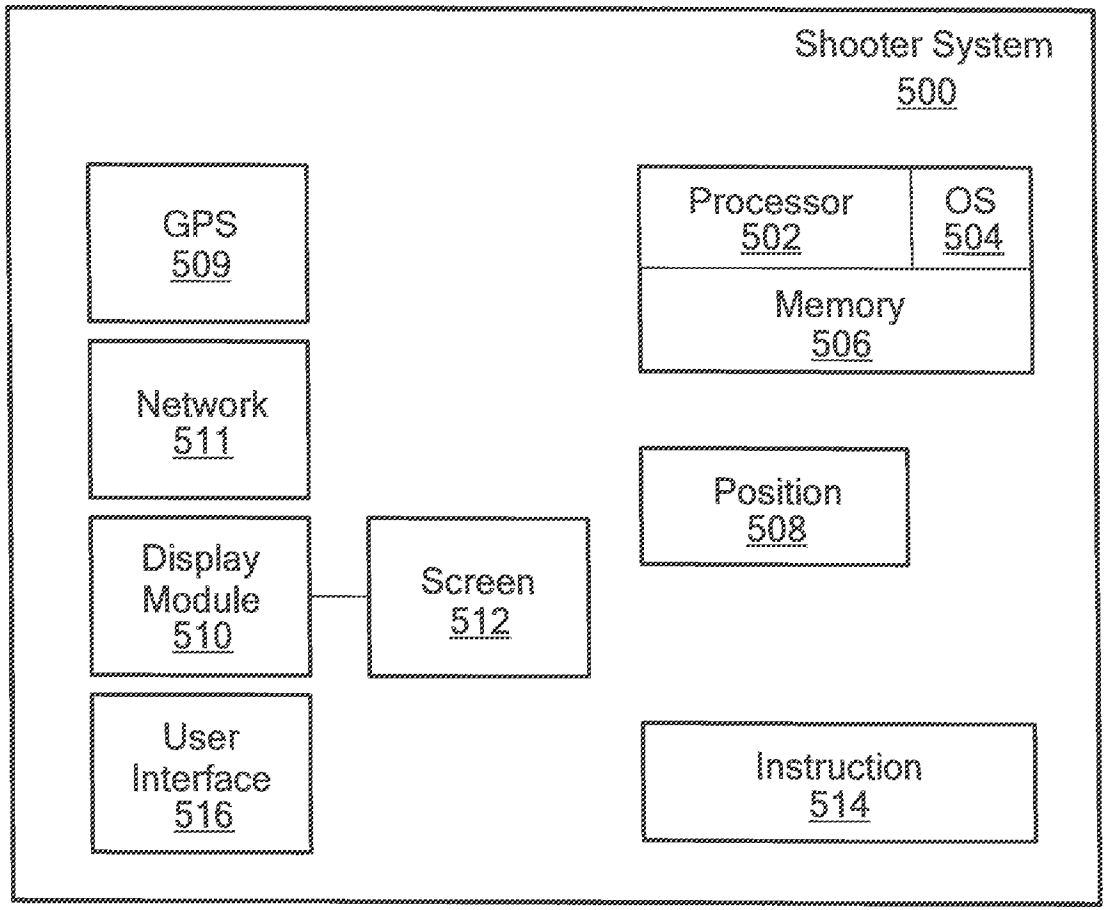
FIG. 5 is a schematic representation of an exemplary implementation of a shooter system.

FIG. 5 shows an exemplary implementation of a shooter system 500 including a processor 502, operating system 504, and memory 506 that enable the shooter system to communicate with the controller system 400 and provide information and instruction commands to the shooter. A position module 508 can determine a shooter position and transmit and receive position information. A GPS module 509 and network module 511 allow wireless communication with GPS satellites and wireless devices.

In an exemplary embodiment, a display module 510 provides information to a display screen 512. An instruction module 514 can provide shooter instruction and detail under control of the controller. For example, the display screen 512 can display information on the instruction regimen, historical performance, performance hints, current conditions, distance, etc. A user interface 516 can provide other information to the shooter, such as a sound to begin shooting in a timed program. The user interface can also include an indicator, such as a red light to indicate unsafe conditions and a green indicator to indicate clearance to begin shooting. An audio component, such as a speaker, can provide speech commands and information to the shooter.

It is understood that in alternative embodiments various functions can be located in different systems and/or apportioned in multiple locations. For example, a scoring module can be located in the controller system and or a shooter system. Historical information for a shooter can be stored in a shooter system and/or a central location, such as the controller system.

Figure 6A:
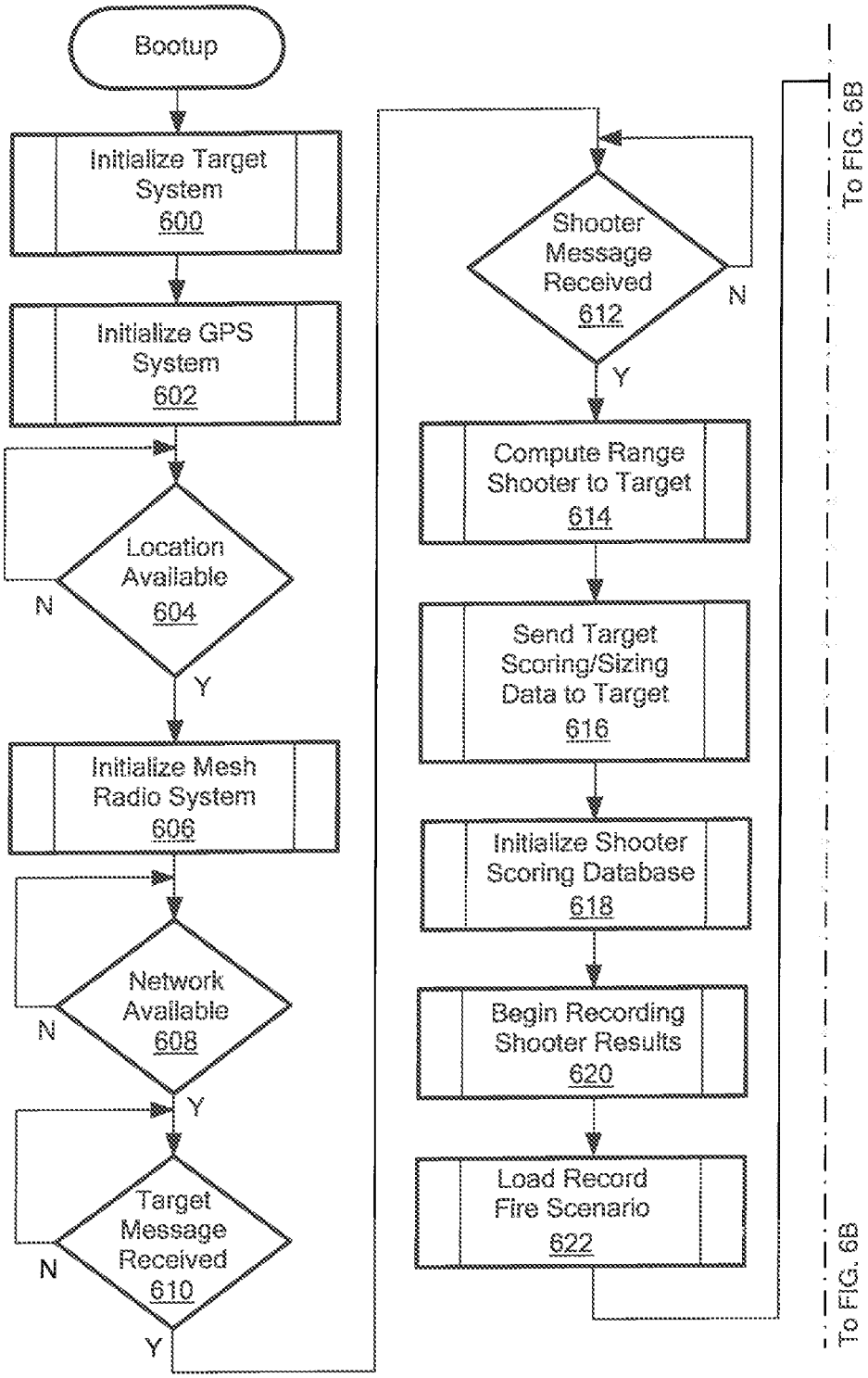
FIGS. 6A and 6B are flow diagrams of an exemplary sequence of steps for implementing small arms training.
Figure 6B:
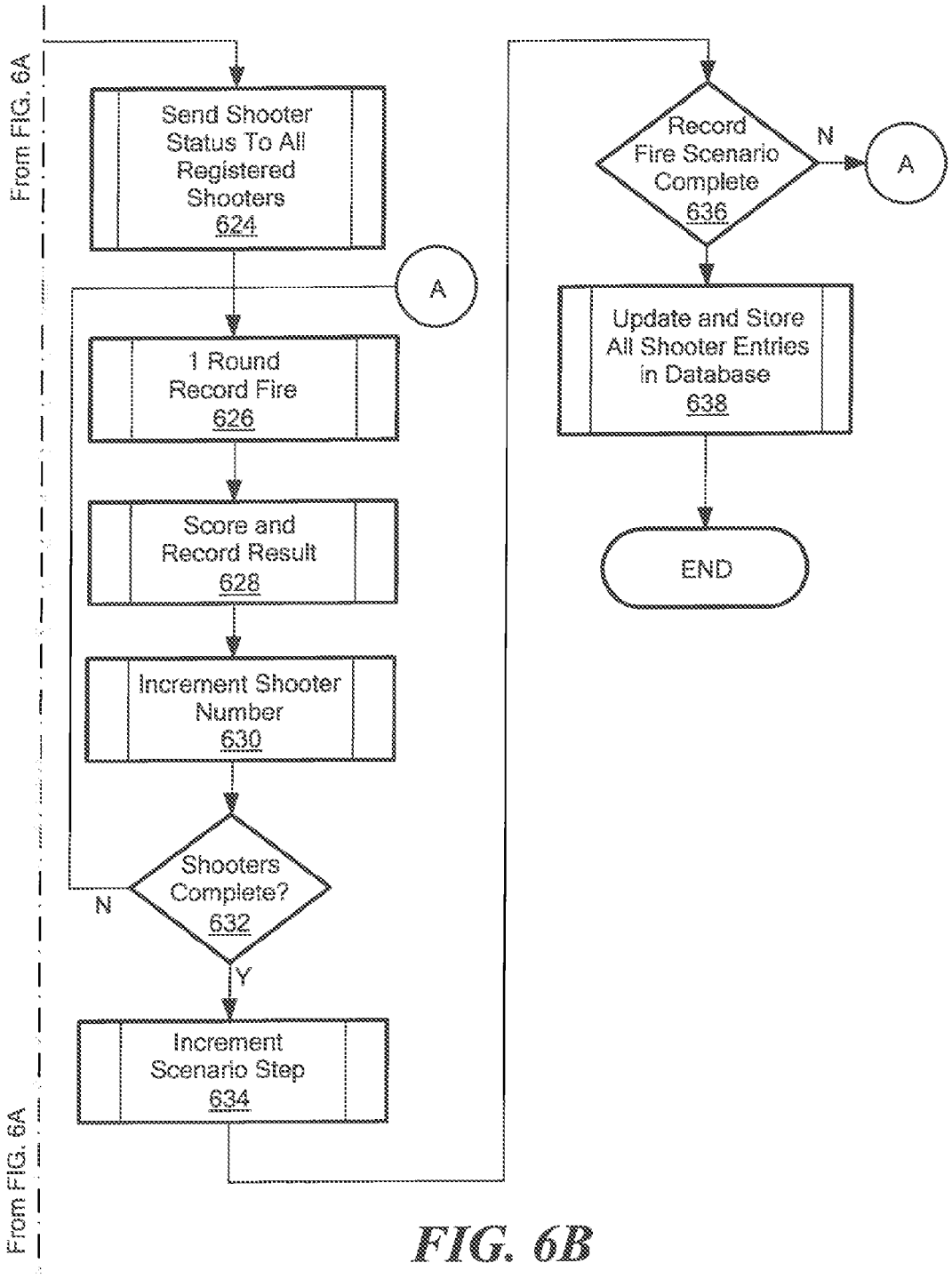

FIGS. 6A and 6B show an exemplary sequence of steps for implementing a small arms training in accordance with exemplary embodiments of the invention. In step 600, a target system is initialized and in step 602 a GPS module for the target system is initialized. In step 604, it is determined whether a suitable location is available for live training. If so, in step 606, a wireless radio system is initialized to enable communication with other components, such as the controller and shooter systems. In steps 608, 610, and 612, it is determined whether a network is available, whether a target message is received, and whether a shooter message is received, respectively.

In step 614, a range for shooter to target is computed based upon the position of the shooter system in relation to the target system. In step 616, the controller sends target scoring and/or sizing information to the target system. As described more fully below, the target scoring is based on bullet trajectory in relation to the sensors determined by time difference of arrival (TDOA) filtered through horizontal and vertical sensors to establish location. In step 618, the shooter scoring database is initialized and in step 620 shooter scoring results are recorded.

In step 622, a fire scenario associated with a selected training regimen is loaded. Shooter status information is sent to active shooters in step 624. In step 626, a first round discharged by the shooter is recorded by the acoustic or other sensors in the target system. In step 628, the first round is scored and the result is stored for the shooter. Additional rounds can be discharged by the shooter and scored in accordance with the training scenario. In step 630, the next shooter is selected for training. In step 632, it is determined whether active shooters have completed the training regimen. If so, in step 634 a further training scenario can be selected and in step 636, the rounds for each shooter can be recorded and scored. In step 638, once shooting is complete, the performance information for each shooter can be updated.

In general, the training system is controlled by a user at the controller system in conjunction with a range training operator. Shooters should be correctly identified prior to training for proper training and scoring. The controller system typically requests that the range training operator identify the course of fire to be used for the training session and whether it will be for the record or is merely a training exercise.

Once the controller/shooter systems 102/106 (FIG. 1) have given the shooters an appropriate preparation period, the shooter system 106 initiates the course of fire by signaling the first shooter, such as on the display, that the shooter should be "Shooter Ready". The other shooters will be signaled into "Standby", however, their shot acoustic sensors will be enabled. The target sensors are configured to ensure that only the designated shooter has fired and no other. Note that in multiple shooters at multiple target scenarios, cross-fires (where a shooter shoots, and hits, a target other than their own, the shooter at the target which received the additional "hit" has the option to accept the higher scoring of the two and the shooter that shot the round will be scored a miss.

The controller system 102 communicates with the shooter system 106 to instruct the first shooter to "Fire" to begin the training. At this point, the display on the shooter system 106 enables their timers for the allotted time for that shot or shot-string. At each shot, the shooter display records the shot, or shot string to make sure that the allotted shot or number of shots has been fired. The target system will have been ready and awaiting the shot under the control of the controller system 102.

In one embodiment, when the round is received by the target system, the position of the round is computed and scored and sent to the controller system 102. The position can also be displayed on the display of the shooter system. The controller system 102 records the shot value and the shooter system display displays the relative shot position and the score and instructs the shooter to either continue with the string of fire, or puts that shooter into "Standby." The next shooter can then be instructed via display on the shooter system to be "Shooter Ready." This is repeated for each shooter through the completion of the course of fire.

Exemplary embodiments of the invention provide a training system that is easily deployable and low cost. Acoustic information from projectiles, such as bullets, is analyzed to provide accuracy information for individual shooters. Targets can be wirelessly linked to a controller to ease set up and tear down. In addition, the system can act as an instructor for implementing a training regimen that provides feedback to the shooter.

Figure 7:
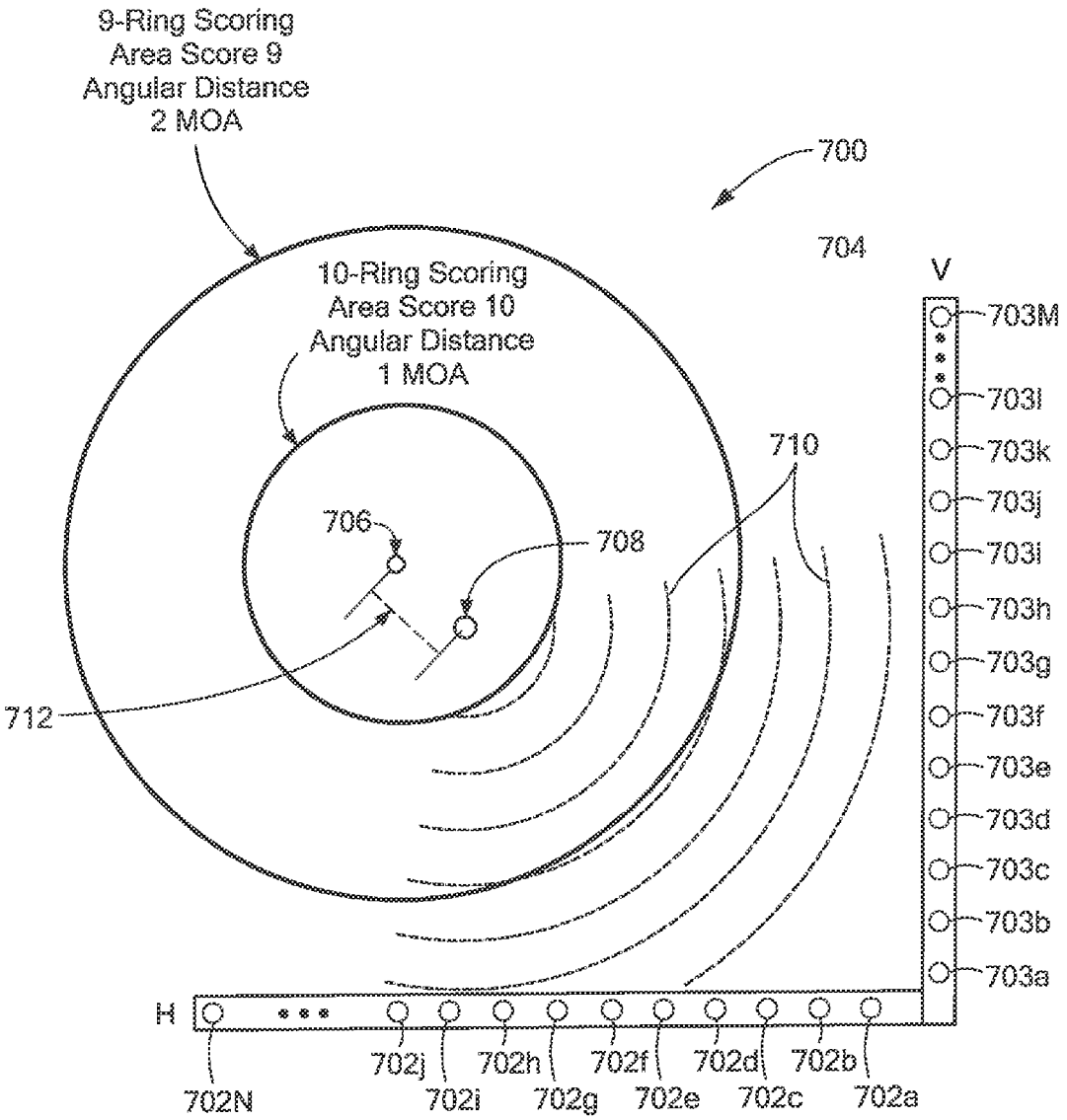
FIG. 7 is a schematic representation of target system with acoustic sensors.

FIG. 7 shows an exemplary target system 700 having a series of acoustic sensors including a row of horizontal sensors 702*a*-N and a row of vertical sensors 703*a*-M. The target system 700 includes a target area 704 having a center 706 When a shot is received at the target at a given shot location 708, sound waves 710 generated by the bullet passage through the air are picked up by the sensors 702, 702 along the horizontal and vertical edges of the target system. The sound waves 710 arrives first at the horizontal and vertical sensor that is the shortest distance from the shot placement 708 in the target area 704, here shows as horizontal sensor 702*i* and vertical sensor 703*h*.

As the sound waves 710 continue to radiate from the bullet location 708, they will be received at the remaining sensors 702, 703 generating a moving peak that originates at the center of the respective, horizontal and vertical, shot placement to enable the computation of an X (horizontal) and Y (vertical) coordinate for the shot.

The angular distance 712 of the shot location 708 from the center 706 of the target area 704 is then computed. This value is then compared to the permissible max distance for each scoring ring to determine the score. Using the sample diagram, the shot placement shown, when computed would have been less than the maximum value for the value 10 scoring, meaning that this shot should receive a score of 10.

It is understood that sensors can be used in any practical amount and location in order to meet the needs of a particular application. It is further understood that information from other sensor types can be used in a similar manner to determine a location of an object passing through the target area. It is expected that with the use of standard audio quality microphones with a response area capable of receiving the impulse, shot placement can be determined within 0.5 of a bullet diameter for a 0.223 (5.56 mm) round.

Figure 8:
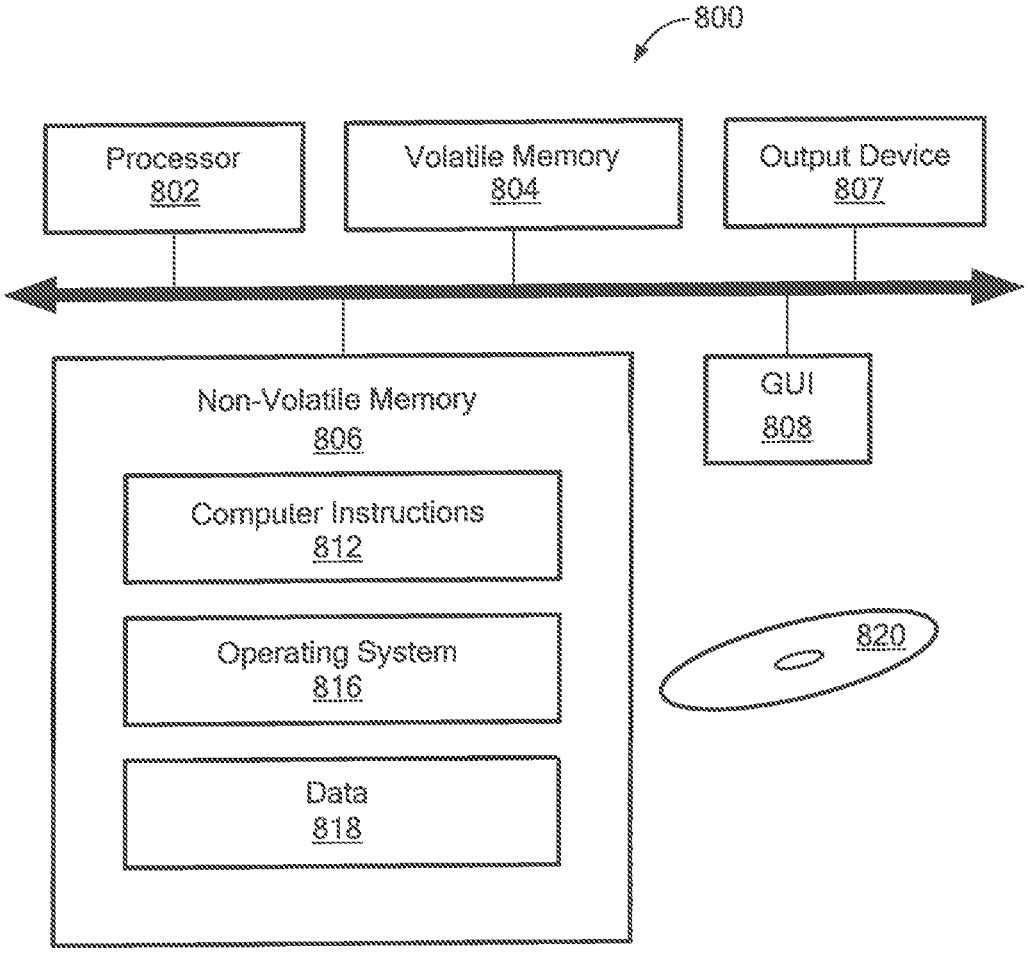
FIG. 8 is a schematic representation of an exemplary computer that can perform at least a portion of the processing described herein.

FIG. 8 shows an exemplary computer 800 that can perform at least part of the processing described herein. The computer 800 includes a processor 802, a volatile memory 804, a non-volatile memory 806 (e.g., hard disk), an output device 807 and a graphical user interface (GUI) 808 (e.g., a mouse, a keyboard, a display, for example). The non-volatile memory 806 stores computer instructions 812, an operating system 816 and data 818. In one example, the computer instructions 812 are executed by the processor 802 out of volatile memory 804. In one embodiment, an article 820 comprises non-transitory computer-readable instructions.

Processing may be implemented in hardware, software, or a combination of the two. Processing may be implemented in computer programs executed on programmable computers/machines that each includes a processor, a storage medium or other article of manufacture that is readable by the processor (including volatile and non-volatile memory and/or storage elements), at least one input device, and one or more output devices. Program code may be applied to data entered using an input device to perform processing and to generate output information.

The system can perform processing, at least in part, via a computer program product, (e.g., in a machine-readable storage device), for execution by, or to control the operation of, data processing apparatus (e.g., a programmable processor, a computer, or multiple computers). Each such program may be implemented in a high level procedural or object-oriented programming language to communicate with a computer system. However, the programs may be implemented in assembly or machine language. The language may be a compiled or an interpreted language and it may be deployed in any form, including as a stand-alone program or as a module, component, subroutine, or other unit suitable for use in a computing environment. A computer program may be deployed to be executed on one computer or on multiple computers at one site or distributed across multiple sites and interconnected by a communication network. A computer program may be stored on a storage medium or device (e.g., CD-ROM, hard disk, or magnetic diskette) that is readable by a general or special purpose programmable computer for configuring and operating the computer when the storage medium or device is read by the computer. Processing may also be implemented as a machine-readable storage medium, configured with a computer program, where upon execution, instructions in the computer program cause the computer to operate.

Processing may be performed by one or more programmable processors executing one or more computer programs to perform the functions of the system. All or part of the system may be implemented as, special purpose logic circuitry (e.g., FPGA (field programmable gate array) and/or an ASIC (application-specific integrated circuit)).

Having described exemplary embodiments of the invention, it will now become apparent to one of ordinary skill in the art that other embodiments incorporating their concepts may also be used. The embodiments contained herein should not be limited to disclosed embodiments but rather should be limited only by the spirit and scope of the appended claims. All publications and references cited herein are expressly incorporated herein by reference in their entirety.

What is claimed is:

1. A system, comprising:

a target system coupled to receive a training regimen, the target system including:

a target area having a target selected based on the training regimen;

a GPS module to determine a location of the selected target;

sensors to detect bullets passing through the target area; and a module to determine locations of the bullets in relation to the selected target from information collected by the sensors; and a shooter system coupled to receive the training regimen, the shooter system including:

a wireless communication module to communicate with the target system; and a user interface to provide information to a shooter, the information including shooter positioning instructions in accordance with the training regimen, wherein target scoring of the system is computed based, at least in part, on the selected target, the locations of the bullets in relation to the selected target, and a determined position of the shooter in relation to the selected target, and wherein the shooter positioning instructions instruct the shooter to a desired position and distance away from the selected target.

2. The system according to claim 1, further including a controller system to control the target system and the shooter system via wireless communication, wherein the controller system provides the training regimen to the target system and the shooter system.

3. The system according to claim 2, wherein the target system, the shooter system and the controller system are each linked via a mesh radio network, and the target system and the shooter system are configured to report respective positions to the controller system, and the controller system is configured to use the target system position and the shooter system position to determine the position of the shooter in relation to the selected target.

4. The system according to claim 1, wherein the sensors comprise a first array of sensors arranged vertically along a first side of the selected target and a second array of sensors arranged horizontally along a second side of the selected target.

5. The system according to claim 1, further including a training module to provide the shooter positioning instructions to the user interface.

6. The system according to claim 1, further including a shooter database to store performance information for shooters from the target system.

7. The system according to claim 1, further including a scoring module to compute the target scoring.

8. The system according to claim 1, wherein the sensors are selected from the group consisting of acoustic sensors, video sensors, laser sensors, electro-optical sensors and temperature sensors.

9. The system according to claim 1, wherein the target system computes the locations of the bullets from a time difference of arrival of sound waves at the sensors.

10. The system according to claim 1, further including a position module to determine a location of the shooter system, wherein the location of the shooter system and the location of the selected target are used to determine the position of the shooter in relation to the selected target, and a distance between the shooter and the selected target.

11. A method, comprising:

employing a target system coupled to receive a training regimen, the target system including:

a target area having a target selected based on the training regimen;

a GPS module to determine a location of the selected target;

sensors to detect bullets passing through the target area; and a module to determine locations of the bullets in relation to the selected target from information collected by the sensors;

employing a shooter system coupled to receive the training regimen, the shooter system including:

a wireless communication module to communicate with the target system; and a user interface to provide information to a shooter, the information including shooter positioning instructions in accordance with the training regimen, and the shooter positioning instructions instructing the shooter to a desired position and distance away from the selected target;

computing target scoring based, at least in part, on the selected target, the locations of the bullets in relation to the selected target, and a determined position of the shooter in relation to the selected target.

12. The method according to claim 11, further including employing a controller system to control the target system and the shooter system via wireless communication, wherein the controller system provides the training regimen to the target system and the shooter system.

13. The method according to claim 11, further including employing a training module to provide the shooter positioning instructions to the user interface.

14. The method according to claim 11, further including employing a shooter database to store performance information for shooters from the target system.

15. The method according to claim 11, further including employing a scoring module to compute the target scoring.

16. The method according to claim 11, wherein the target system computes the locations of the bullets from a time difference of arrival of sound waves at the sensors.

17. The method according to claim 11, further including providing feedback to the shooter through the user interface based on at least one of the target scoring, a timing of shots fired by the shooter, a number of shots fired by the shooter, and current performance of the shooter in comparison to historical performance of the shooter.

18. A system, comprising:

a target system means for determining locations of bullets in relation to a target from information collected by sensors proximate a target area, wherein the target system means is coupled to receive a training regimen and the target is selected based on the training regimen;

a shooter system means for communicating distance information with the target system, wherein the shooter system means is coupled to receive the training regimen;

a user interface means for providing information to a shooter, the information including shooter positioning instructions in accordance with the training regimen, wherein the shooter positioning instructions instruct the shooter to a desired position and distance away from the selected target; and a scoring means for computing target scoring, wherein the target scoring is computed based, at least in part, on the selected target, the locations of the bullets in relation to the selected target, and a determined position of the shooter in relation to the selected target.

19. A system, comprising:

a target system coupled to receive a training regimen, the target system including:

a target area having a target selected based on the training regimen;

a target system GPS module to determine a location of the selected target;

sensors to detect bullets passing through the target area; and a module to determine locations of the bullets in relation to the selected target from information collected by the sensors; and a shooter system coupled to receive the training regimen, the shooter system including:

a wireless communication module to communicate with the target system;

a shooter system GPS module to determine a location of the shooter system;

a user interface to provide information to a shooter, the information including shooter positioning instructions in accordance with the training regimen; and a controller system to control the target system and the shooter system and to determine whether a suitable location is available for live training, the controller system providing the training regimen to the target system and to the shooter system, and including:

a controller system GPS module to determine a location of the controller system, wherein the controller system, the target system and the shooter system are each linked via a mesh radio network and configured to communicate respective positions to each other based on GPS information obtained by the controller system GPS module, the target system GPS module, and the shooter system GPS module, and wherein the controller system is configured to use the target system position and the shooter system position to determine the position of the shooter in relation to the selected target, wherein target scoring of the system is computed based, at least in part, on the selected target, the locations of the bullets in relation to the selected target, and the determined position of the shooter in relation to the selected target, and wherein the shooter positioning instructions instruct the shooter to a desired position and distance away from the selected target.

20. The system according to claim 19, wherein the target scoring is further based on caliber of the bullets and type of a firearm from which the bullets are received.

* * * * *